US006092307A

United States Patent [19]

Singer et al.

[11] Patent Number: 6,092,307

[45] Date of Patent: Jul. 25, 2000

[54] SELF-LOCATING SOLE

[75] Inventors: Joel A. Singer, Quincy; Joseph Ferreira, Raynham, both of Mass.

[73] Assignee: Spalding Sports Worldwide, Inc., Chicopee, Mass.

[21] Appl. No.: 09/236,847

[22] Filed: Jan. 25, 1999

[51] Int. Cl.[7] ..... A43B 13/28

[52] U.S. Cl. ..... 36/12; 36/30 R; 36/31; 36/17 R

[58] Field of Search ..... 36/12, 30 R, 31, 36/25 R, 15, 22 R, 127, 17 R, 81; 12/142 T, 33.6, 128 D

[56] References Cited

U.S. PATENT DOCUMENTS

| | | | |
|---|---|---|---|
| 2,084,892 | 6/1937 | Cocozella | 36/22 R |
| 2,211,057 | 8/1940 | Duckoff | 36/22 R |
| 2,212,612 | 8/1940 | Mansfield | 36/22 R |
| 2,333,201 | 11/1943 | Russell | 36/30 R |
| 2,366,039 | 12/1944 | Mackensen | 36/22 R |
| 2,826,770 | 3/1958 | Freeman | 36/17 R |
| 3,028,690 | 4/1962 | Bailey | 36/17 R |
| 3,125,816 | 3/1964 | Gartner | 36/17 R |
| 3,271,887 | 9/1966 | Werman | 36/17 R |
| 3,318,025 | 5/1967 | Antelo | 36/15 |
| 3,492,744 | 2/1970 | Bernier et al. | 36/59 |
| 3,559,308 | 2/1971 | Bernier et al. | 36/2.5 |
| 5,255,451 | 10/1993 | Tong et al. | 36/30 R |
| 5,657,556 | 8/1997 | Bemis | 36/30 |

FOREIGN PATENT DOCUMENTS

| | | | |
|---|---|---|---|
| 86/04489 | 8/1986 | WIPO | 36/15 |

*Primary Examiner*—M. D. Patterson

[57] ABSTRACT

A self aligning sole for use in shoes, especially sports shoes of welted construction. The outer sole has a shaped raised portion. The mid-sole has a cutout with a shape complementary to the raised portion shape. During assembly of the shoe, the outer sole raised portion registers with the mid-sole cutout, thereby aligning the outer sole with the mid-sole.

5 Claims, 5 Drawing Sheets

SELF-LOCATING SOLE

BACKGROUND OF THE INVENTION

The present invention relates to shoes, and more particularly to sports shoes having outer soles with sockets for spikes or cleats.

Modern footwear is typically comprised of a shoe upper which is attached to some or all of an inner sole, a mid-sole and an outer sole.

The details of the attachment of these components are well known in the art and can include cementing and/or stitching. Particularly with so-called "welt" construction, great care is required in the alignment of the components to produce a functional and aesthetically pleasing shoe. To lessen the care required, raw outer soles are typically oversized compared to the mid-sole so that some eccentricity or offset between the outer sole and the mid-sole is permissible during the manufacturing step of attaching the outer sole to the mid-sole. The use of an oversized outer sole, while lessening the care required to align the outer sole to the mid-sole, results in the addition of an extra step in the manufacturing process to trim the excess material after attachment of the outer sole. In addition, even with the use of an oversized outer sole, only a small amount of eccentricity can be accommodated.

For many years, the highest quality golf shoes have been made utilizing welt construction techniques. Such shoes employed nail-type spikes which were threaded into sockets carried by a plate mounted on the hidden side of the outer sole. The rigidity of such a plate adversely affected the flexibility of the sole. Furthermore, to avoid the feeling of a "lump" in the sole due to the plate, the upper surface of the outer sole was either very thick so that the plate could be mounted in a cavity formed therein, or else the upper surface of the outer sole was covered with filler material to raise the level to that of the plate.

Recently, a growing trend has developed away from the use of metal spikes, toward the use of disc-like, softer spikes which do less damage to the putting greens. Such spikes often utilize the same threaded mounting as did traditional metal spikes, and can be directly substituted in the threaded sockets supported on a common plate carried by the outer sole. New forms of sockets have been developed to accommodate further developments in such softer spikes, thereby eliminating the need for a metal plate, but nevertheless failing to overcome two long-standing deficiencies.

First, the support structure for the sockets, whether in the form of a molded web or molded individual housings, presents a thickness of relatively rigid structure which is thicker than the ideal nominal thickness of the outer sole. This differential will, if not accommodated, induce discomfort in the user, and if accommodated in the traditional manner, requires the extra cost associated with increasing the thickness of the sole, or using filler material to bring the upper surface of the sole even with the plate or housing projection. Secondly, despite improvements in the efficiency of manufacturing techniques, a laborer, rather than automated equipment, is typically required to accurately locate the outer sole onto the mid-sole, so that the outer sole can be attached thereto by sewing and/or adhesive. This locating step is not as easy as might appear at first glance, because the outer sole and mid-sole are slightly oversized during construction and there is no structural or visual cue as to correct alignment. The laborer must, in essence, position the outer sole against the inner sole until an essentially uniform overlap at the edges is evident, and maintain this overlap as the shoe is placed into a sewing machine (for stitching) or a heat press (for curing adhesive). To assist a laborer in this regard, for each size of shoe, a particular size mid-sole and a particular size outer sole are required.

SUMMARY OF THE INVENTION

It is an object of the invention to provide components and methods whereby a unitary outer sole registers with and is aligned to a mid-sole during construction.

It is a further object of the invention to improve the flexibility and comfort of sports shoes having spikes, cleats, or the like projecting from the outer sole.

The present invention more quickly and accurately aligns the outer sole with the mid-sole during the construction of a shoe by the use of a unitary mid-sole containing a shaped cutout and a unitary outer sole containing a shaped raised portion. Although the novelty of the present invention resides in the construction and interaction of the mid-sole and the outer sole, whereby the shoe upper and the inner sole may be of any material, design or construction known in the art, the invention has particular advantage in sports shoes having welt construction.

According to the invention the mid-sole contains a shaped cutout with the edges of the cutout defining a mid-sole cutout perimeter. The mid-sole is attached to the inner sole, preferably via a welt. The outer sole top surface is substantially flat with a raised portion. The outer sole raised portion has a perimeter shape which registers with the mid-sole cutout perimeter shape, thereby quickly aligning the outer sole to the mid-sole. The outer sole is attached to the mid-sole after registry and alignment. The method of attaching the mid-sole to the inner sole and the outer sole to the mid-sole is not critical to the invention and may follow any conventional practice. For golf shoes, this attachment can be with adhesive only.

During manufacture of the shoe an operator can quickly select an outer sole containing a raised portion with a raised portion perimeter shape and slide the raised portion along the mid-sole until the raised portion perimeter shape registers with the mid-sole cutout. Little care is needed to establish registry and consequently accurate alignment of the outer sole to mid-sole.

As can readily be seen, the innovative use of an outer sole raised portion having a raised portion perimeter shape which registers within a mid-sole cutout having a mid-sole cutout perimeter shape allows a number of benefits both in the design and the manufacture of the shoe. During manufacture, the registry allows the shoe to be more easily and quickly assembled. The registry also allows more accurate positioning of the outer sole with respect to the mid-sole and remainder of the shoe during assembly. This accuracy of positioning allows the outer sole to be made smaller than would be possible with conventional shoe components and manufacturing methods while still resulting in a functionally and aesthetically acceptable shoe. The mid-sole cutout and and registering outer sole raised portion allow a preferred flex and feel of the shoe to be obtained. The raised portion may also be comprised of a material which will provide cushioning for the wearer's foot. It should be noted that the novel registry of the outer sole raised portion to the mid-sole cutout and the attendant benefits may be achieved while utilizing predominantly conventional and accepted shoe components and construction techniques.

BRIEF DESCRIPTION OF THE DRAWINGS

Other objects and advantages of the invention will become evident to one of ordinary skill in the art from the following detailed description made with reference to the accompanying drawings, in which.

DESCRIPTION OF THE PREFERRED EMBODIMENTS

Figure 1:
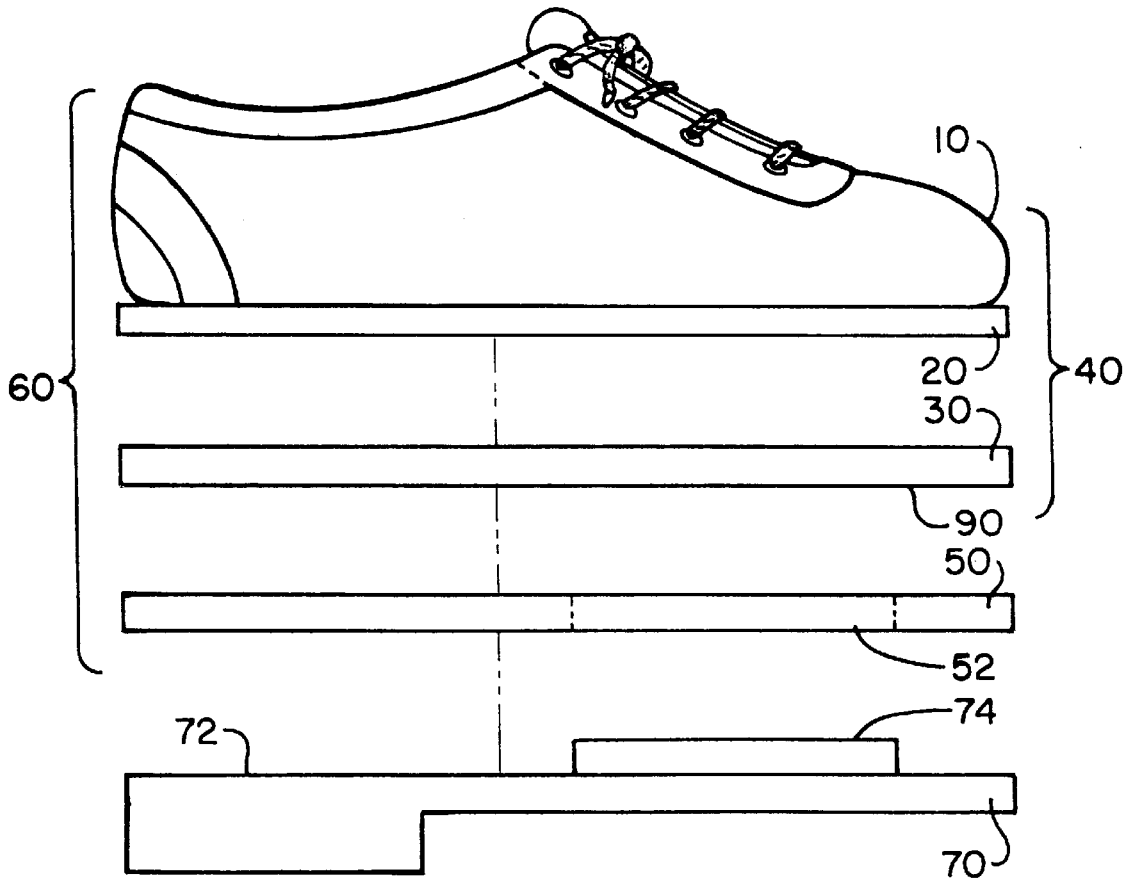
FIG. 1 is an exploded side view, partially in phantom, of the main components of a shoe which embodies the present invention.

In the following description of the present invention, like reference numerals represent identical or corresponding parts throughout the different views.

Figure 5:
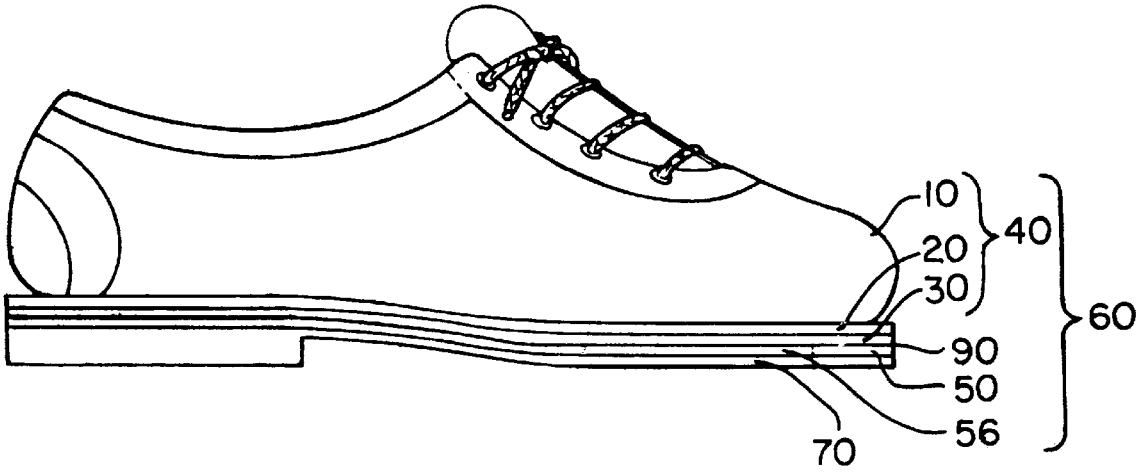
FIG. 5 is a side view, partly in phantom of a welted shoe constructed according to the present invention showing the components, sub-assemblies and mid-sole cavity.

Although the present invention has application to a wide variety of footwear, it is well suited to a welt-construction sport shoe and particularly suited to a golf shoe. FIGS. 1 and 5 show different views of the main components of a shoe incorporating the present invention. The shoe upper 10 and the shoe inner sole 30 are well known in the art and may be comprised of any material suitable for the activity to which the shoe is intended.

Similarly, the invention allows the unitary mid-sole 50 (i.e., having the overall shape of a footprint) to be comprised of any material suitable for the activity for which the shoe is intended. The mid-sole has at least one cutout 52, with the perimeter 54 of the cutout defining a perimeter shape. A preferred embodiment of the invention shown in FIG. 2, places the mid-sole cutout 52 in the forefoot region forward of the arch area. When the mid-sole 50 is attached to the inner sole 30, the cutout perimeter 54 and the bottom surface of the inner sole define a cavity 56, shown in FIG. 5.

Figure 2:
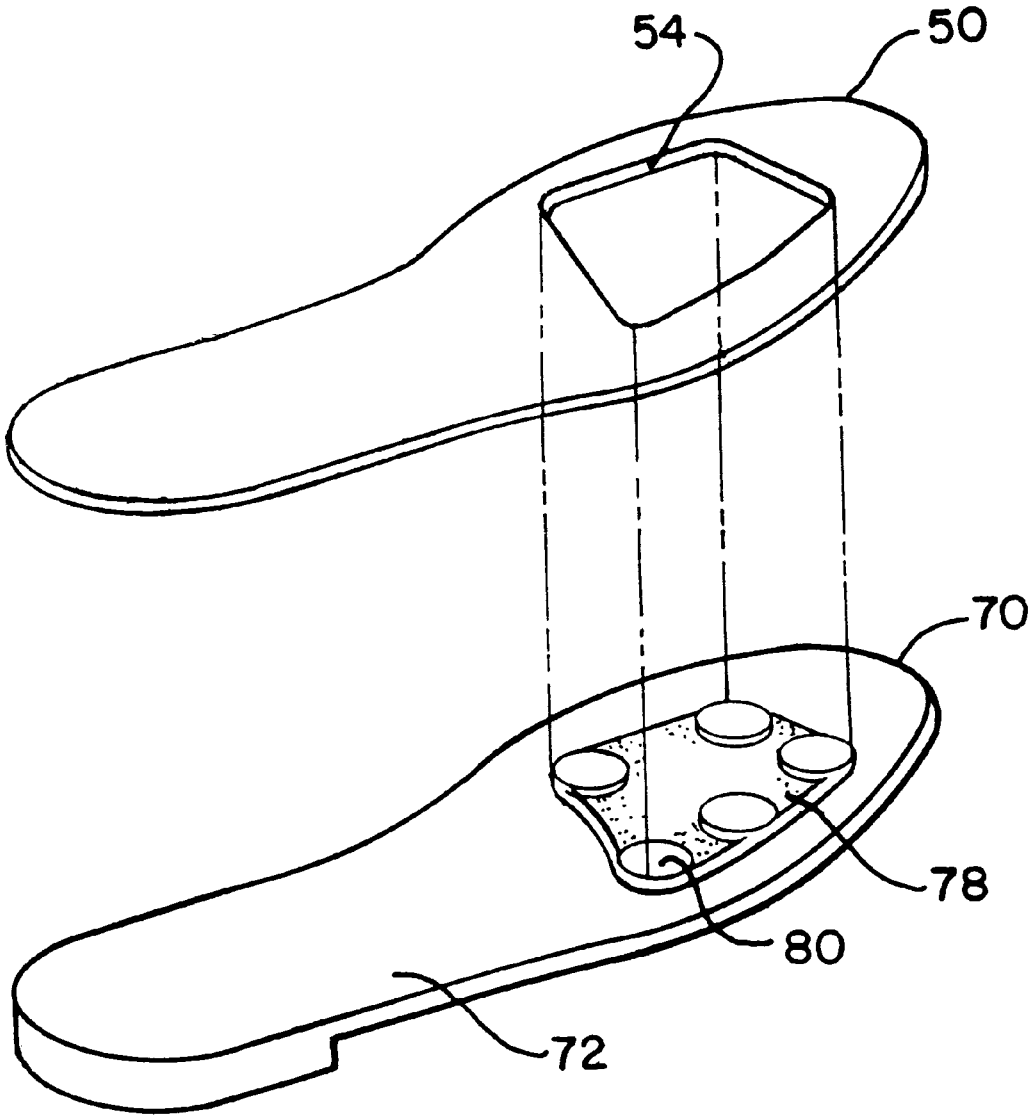
FIG. 2 is a perspective view showing the mid-sole including the cutout, the outer sole including the raised portion and the registry of the outer sole raised portion within the mid-sole cutout.
Figure 3:
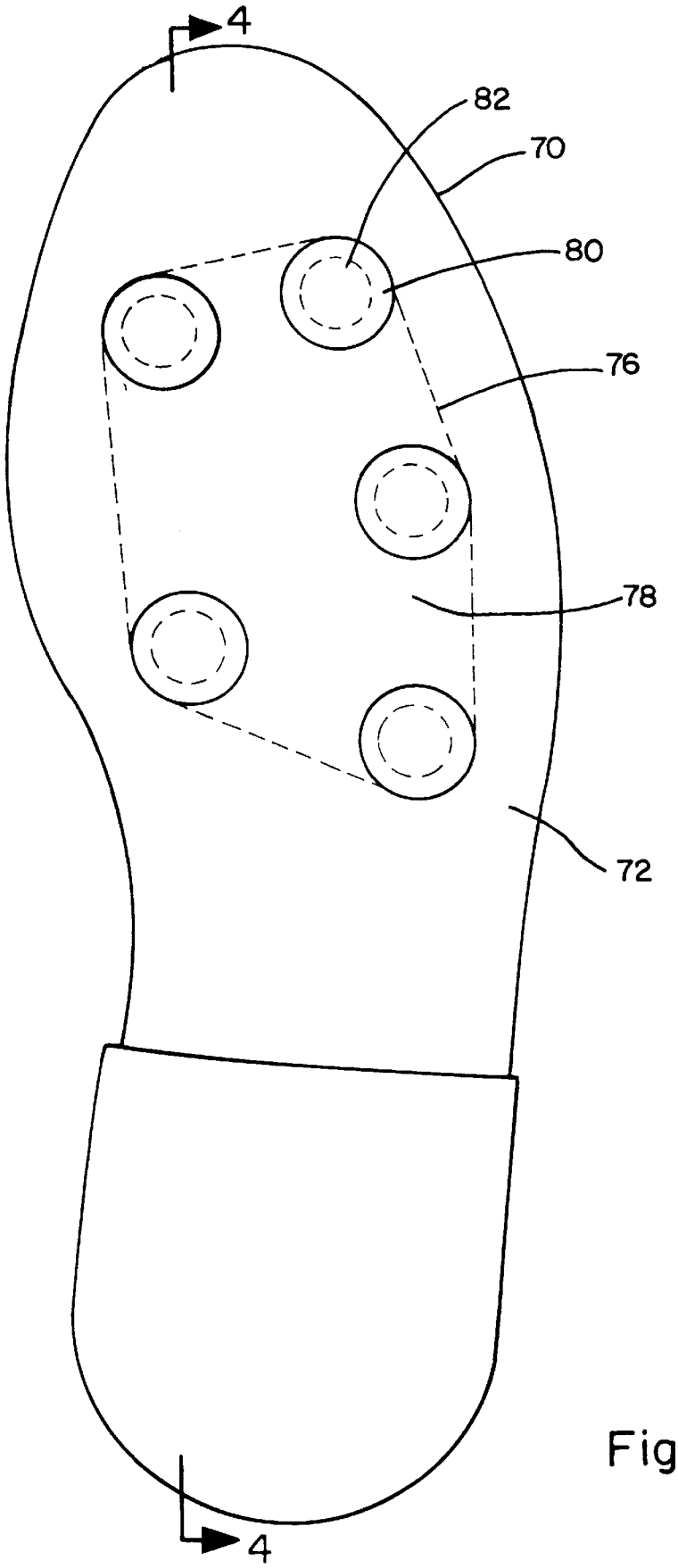
FIG. 3 is a top view showing an outer sole with an alternative embodiment of the outer sole raised portion wherein a plurality of distinct housings for spike sockets define the perimeter shape of the outer sole raised portion.

The invention further allows the unitary outer sole 70 to be designed for any intended function and manufactured of any materials suitable for that function. As seen in FIGS. 1 and 3, the outer sole has a substantially flat top surface 72 with a raised portion 74 projecting upward from this substantially flat top surface. The outer sole raised portion 74 has a perimeter defining a perimeter shape 76 which fits within the cavity 56 formed by the mid-sole cutout 52 and the inner sole bottom surface and registers with the mid-sole cutout perimeter shape. FIG. 2 shows the registry of the outer sole raised portion 74 with the mid-sole cutout 52. Preferably, a clearance of only about 1–2 mm is achieved. During assembly of the shoe, this registry of the raised portion perimeter shape 76 with the mid-sole cutout perimeter shape allows the outer sole 70 to be quickly and accurately aligned with the mid-sole 50.

FIG. 5 shows the invention used in the so-called welt construction of shoes. In this construction a welt strip 20, typically of leather, is simultaneously sewn to the perimeter of the shoe upper 10 and the inner sole 30, thereby joining these as a unitary sub-assembly 40. It is also common to use a filler material 90, such as cork, which will be considered part of the bottom surface as needed to produce a uniform surface at, for example, the bottom of the inner sole 30 in the sub-assembly 40. The mid-sole 50 is then typically sewn to the welt of the first sub-assembly 40 to produce a second sub-assembly 60. It is this second sub-assembly 60 which the laborer holds in one hand while locating the outer sole 70 thereon, and continues holding these in alignment for subsequent sewing or adhesive bonding. It can be readily appreciated that in the sub-assembly 60, the mid-sole cutout 52 and abutting bottom surface of inner sole 30, form a cavity 56 having a shaped perimeter in which the corresponding or mating shaped perimeter of the raised portion 74, provides positive locating of the outer sole relative to the mid-sole. Because of this positive locating, there is no need to utilize the perimeter of the entire mid-sole and the perimeter of the entire outer sole as alignment aids. As a result, a manufacturer can utilize the same size of mid-sole for shoes which are up to one-half size smaller or larger than that mid-sole size, thereby saving on the costs of materials and inventory tracking.

A wide variety of shapes and sizes of the mid-sole cutout 52 and outer sole raised portion 74 would allow the novel registration and alignment of the outer sole 70 to the mid-sole 50. It is also possible for the mid-sole 50 to contain multiple cutouts (not shown) so that a cavity is created between each of these cutouts and the inner sole bottom surface. The outer sole top surface would have raised portions corresponding in number and shape to the mid-sole cutouts so that the outer sole would register with, and be aligned to, the mid-sole.

The outer sole raised portion 74 is also capable of variation while still retaining the novel registry and alignment features of this invention. FIG. 1 shows one variation where the outer sole raised portion 74 is molded integrally with the outer sole 70. The outer sole raised portion 74 may also be comprised of a material with different physical characteristics than the outer sole material, such as a cushion material, which is attached to the outer sole top surface 72.

Figure 4:
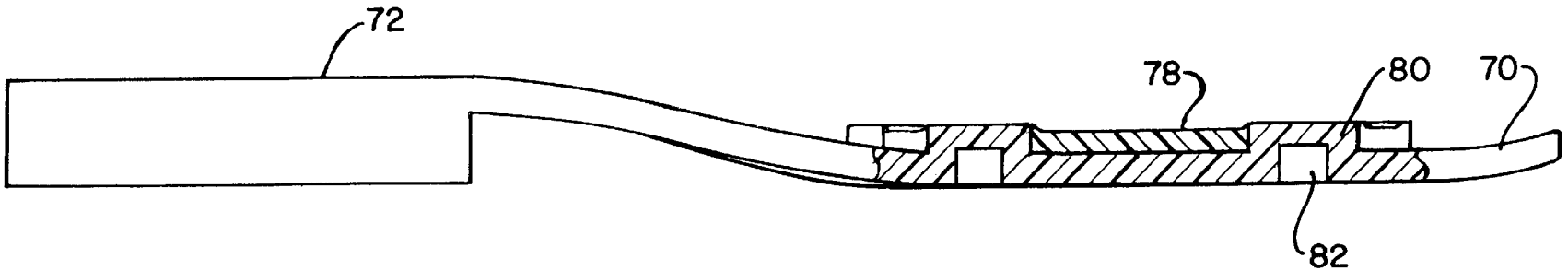
FIG. 4 is a side view, partly in section, of the outer sole component of FIG. 3 along line 4—4.

In another embodiment of the invention, shown in FIGS. 3 and 4, the outer sole includes a plurality of distinct housings 80 for receiving a respective plurality of spikes or spike sockets 82. The housings 80 may be integrally formed with the outer sole 70 or separately attached. In one preferred embodiment of the invention for a golf shoe, the plurality of integral housings 80 extend upward from the outer sole top surface. The top surface of the outer sole raised portion is defined by the top surfaces of the housings. An imaginary line encircling the plurality of housings defines the outer sole raised portion perimeter shape 76. The interior volume of the outer sole raised portion perimeter shape 74 is occupied only by the housings 80. In a variation of this embodiment, the volume of the outer sole raised portion is substantially occupied by the housings 80 and a filler material 78. The filler may be comprised of any material. In one embodiment, the filler is comprised of a cushion material, such as plastic foam or EVA.

While various embodiments of the foregoing invention have been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed:

1. A golf shoe of welted construction, comprising:

a golf shoe upper having a bottom surface;

an insole welted to said golf shoe upper, said insole having a top surface and a bottom surface, including a filler material on said insole bottom surface;

a unitary mid-sole welted to said insole, said mid-sole having a top surface adjacent to said filler material, a bottom surface, and a cutout, said cutout having a perimeter defining a perimeter shape, said filler material and said cutout perimeter defining a cavity;

a unitary outer sole having a bottom surface and a substantially flat top surface attached to said mid-sole bottom surface, said outer sole including a plurality of housings, each said housing projecting from said outer sole top surface, whereby an imaginary line encircling said plurality of housings defines a raised portion perimeter shape, a top of each housing defines a raised portion top surface and a raised portion volume is defined by said raised portion top, said raised portion perimeter shape and said outer sole substantially flat top surface; and a golf spike socket structure mounted within each said housing and extending through said outer sole bottom surface;

said raised portion perimeter shape fitting within said cavity and registering within about 2 mm with said cutout perimeter shape.

2. A golf shoe as in claim 1, wherein:

said mid-sole cutout is located in a forefoot region, and said cutout perimeter shape has five sides and five corners; and said outer sole raised portion perimeter shape has five sides and five corners, with a housing located in each of said corners.

3. In a shoe having a mid-sole containing a shaped cutout, an easy aligning outer sole comprising:

a unitary outer sole with a top surface including a plurality of discrete raised portions and a bottom surface, each said discrete raised portion comprising a housing, a figurative line encircling said plurality of raised portions defining a raised portion perimeter shape complimentary to the mid-sole cutout, said raised portion perimeter shape comprised of said plurality of housings and a filler material wherein the raised portion perimeter shape registers with the cutout as the outer sole is attached to the mid-sole.

4. A golf shoe, comprising:

a shoe upper having a bottom surface;

an insole with a top surface attached to said shoe upper, and a bottom surface;

a unitary mid-sole having a top surface attached to said insole, a bottom surface, and a cutout with a perimeter defining a perimeter shape, the insole bottom surface and the cutout perimeter defining a cavity; and a unitary outer sole having a substantially flat top surface attached to said mid-sole bottom surface, and a bottom surface, a raised portion comprised of a plurality of bosses projecting from said substantially flat top surface, an imaginary line encircling said bosses defining a perimeter shape which registers with the cutout perimeter shape and fits within the cavity thereby aligning said outer sole with said mid-sole, a top of each boss defining a raised portion top surface and the raised portion perimeter shape and the top surface defining a raised portion volume wherein the raised portion volume is substantially filled by the plurality of bosses and a cushion material.

5. A golf shoe, comprising:

a shoe upper having a bottom surface;

an insole with a top surface attached to said shoe upper, and a bottom surface;

a unitary mid-sole having a top surface attached to said insole, a bottom surface, and a cutout with a perimeter defining a perimeter shape, the insole bottom surface and the cutout perimeter defining a cavity; and a unitary outer sole having a substantially flat top surface attached to said mid-sole bottom surface, and a bottom surface, a raised portion projecting from said substantially flat top surface, at least one cleat or cleat socket mounted partially within said raised portion and extending through said outer sole bottom surface, said raised portion having a perimeter shape which registers with the cutout perimeter shape and fits within the cavity thereby aligning said outer sole with said mid-sole.

* * * * *